US006356028B1

(12) United States Patent
Legagneux et al.

(10) Patent No.: US 6,356,028 B1
(45) Date of Patent: Mar. 12, 2002

(54) SCREEN CONTROL WITH CATHODES HAVING LOW ELECTRONIC AFFINITY

(75) Inventors: Pierre Legagneux, Voisins le Bretonneux; Didier Pribat, Sevres, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/485,719

(22) PCT Filed: Jul. 2, 1999

(86) PCT No.: PCT/FR99/01597

§ 371 Date: Mar. 2, 2000

§ 102(e) Date: Mar. 2, 2000

(87) PCT Pub. No.: WO00/02183

PCT Pub. Date: Jan. 13, 2000

(30) Foreign Application Priority Data

Jul. 3, 1998 (FR) ..... 98 08555

(51) Int. Cl.[7] ..... G09G 3/22

(52) U.S. Cl. ..... 315/169.1; 315/169.3; 345/75; 345/76

(58) Field of Search ..... 315/169.3, 169.1; 345/76, 75

(56) References Cited

U.S. PATENT DOCUMENTS 5,356,510 A 10/1994 Pribat et al.
5,581,146 A 12/1996 Pribat et al.
5,786,795 A * 7/1998 Kishino et al. ..... 345/75

* cited by examiner

*Primary Examiner*—David Vu
(74) *Attorney, Agent, or Firm*—Oblon, Spivak, McClelland, Maier & Neustadt, P.C.

(57) ABSTRACT

A drive system which makes it possible to drive a matrix of picture elements, each including a cathode made of a material with low electron affinity. Each of crossover-point circuits include a switching device associated with a cathode of a picture element and makes it possible, with the aid of memory circuits, to connect the cathode to a current source during a time necessary for the driving of all the rows of the matrix and to regulate the current conduction of the corresponding picture element. Such a drive system may find particular application to electron guns and display screens.

17 Claims, 4 Drawing Sheets

SCREEN CONTROL WITH CATHODES HAVING LOW ELECTRONIC AFFINITY

BACKGROUND OF THE INVENTION

Discussion of the Background

Materials with negative electron affinity or low electron affinity are known, which are generally of carbon with diamond structure. These materials have the great advantage of emitting electrons under weak extraction fields (of the order of 10 V/$\mu$m). Since it is easy to obtain such fields on a planar thin film, it is no longer necessary to create tips in order to fabricate cathodes, and this facilitates the fabrication process. For example, in a tipped cathode it is essential to control the diameter of the holes in the extraction grid to within 0.1 $\mu$m.

W. Zhu et al. have studied polycrystalline diamond deposits obtained by CVD (chemical vapour deposition) and have shown that the emission density increases significantly with the density of defects which the films contain. Certain deposition conditions make it possible to obtain layers exhibiting, for fields of the order of 30 V/$\mu$m, current densities of 10 mA/cm$^2$, i.e. a sufficient value for fabricating a screen with a luminosity of 300 cd/m$^2$. However, the emissive properties of the films do not appear very uniform because they depend greatly on the surface roughness (of the order of the grain size ≈5 $\mu$m) and the defect density. In field-emission screens whose cathodes are made of polycrystalline material, it is therefore found that the display is not uniform.

SUMMARY OF THE INVENTION

The invention makes it possible to solve this problem by proposing to make the cathodes of an information display screen from a low-electron-affinity material of amorphous or crystalline structure which exhibits a smooth surface condition. However, such cathodes cannot emit a strong electron flux (less than 1 mA/cm$^2$, about $10^{-5}$ A/cm$^2$). In a matrix screen, for example of 1000×1000 rows, the picture elements are in principle driven row by row. In order to solve the problem of low power emitted by each pixel (each cathode), it is proposed to associate, with each cathode, a switching device which sustains the drive of the cathode during a frame time, a frame time being the total time necessary for driving all the rows of a screen one after the other. Under these conditions, it can be assumed that the intensity emitted by a cathode integrated over a frame time is virtually equivalent to the power which would have been necessary in a row-by-row drive, multiplied by the number of rows. In other words, according to the invention, the low-electron affinity cathodes characterized by a low emission density (<1 mA/cm$^2$) can be used in a display screen so long as they are each combined with a drive circuit which sustains the current supply during a frame time, which makes it possible to have a current supply n times smaller than that which would have been necessary in a row-by-row drive, n being the number of rows of the screen.

The invention therefore relates to a drive system for a screen comprising at least one electron-emission picture element with low electron affinity, characterized in that it includes:

- a set of cathodes arranged in rows and columns, and driven row by row;
- a switching device associated with the cathode of each picture element and making it possible to connect the said cathode to a current source during a time necessary for the driving of all the rows and to regulate the current conduction of the corresponding picture element.

BRIEF DESCRIPTION OF THE FIGURES

The various subjects and characteristics of the invention will become more clearly apparent from the description below and the appended figures, in which.

DESCRIPTION OF THE PREFERRED EMBODIMENT

Figure 1A:
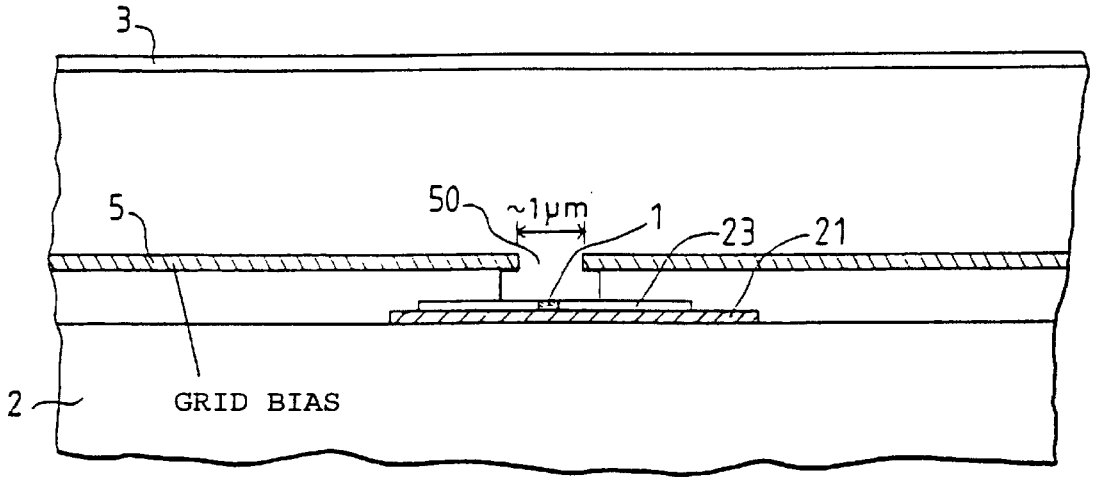
FIGS. 1*a* and 1*b* represent simplified examples of a cathodic emission device in which the cathode is a material with low electron affinity.

FIG. 1*a* represents a basic structure of the device according to the invention. This device includes, on a substrate 2, a layer 21, of material with high electron affinity. On this layer 21, there is at least one element 1 of material with low electron affinity, called cathode. In the case of a display device, there is a layer of conductive material, called anode 3, facing the cathode at a distance $d_{ca}$ from the cathode.

The layer 21 is preferably conductive and makes it possible to drive the cathode electrically. If the substrate exhibits the properties of the layer 21, the latter may be omitted.

According to the invention, the cathode is made of material deposited in amorphous form so as to exhibit a good surface condition. Its crystalline structure may optionally be modified by a post-deposition treatment (heat or laser treatment). This material may, for example, be of carbon with the following structure: a-C:H; a-C:H:N.

Figure 1B:
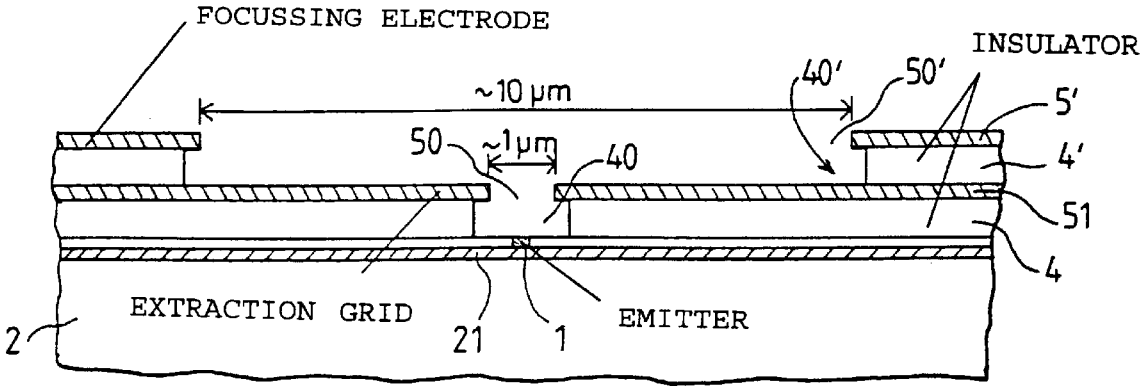

FIG. 1*b* represents an electron microgun. Such a structure is similar, as regards the electron-emission part (cathode), to that in FIG. 1*a*. However, the anode will be replaced by a target (not shown). Furthermore, an electrode 5' is provided for focusing the electron beam. This electrode is located above the grid 5 and surrounds the electron-emission art of the device.

Figure 2:
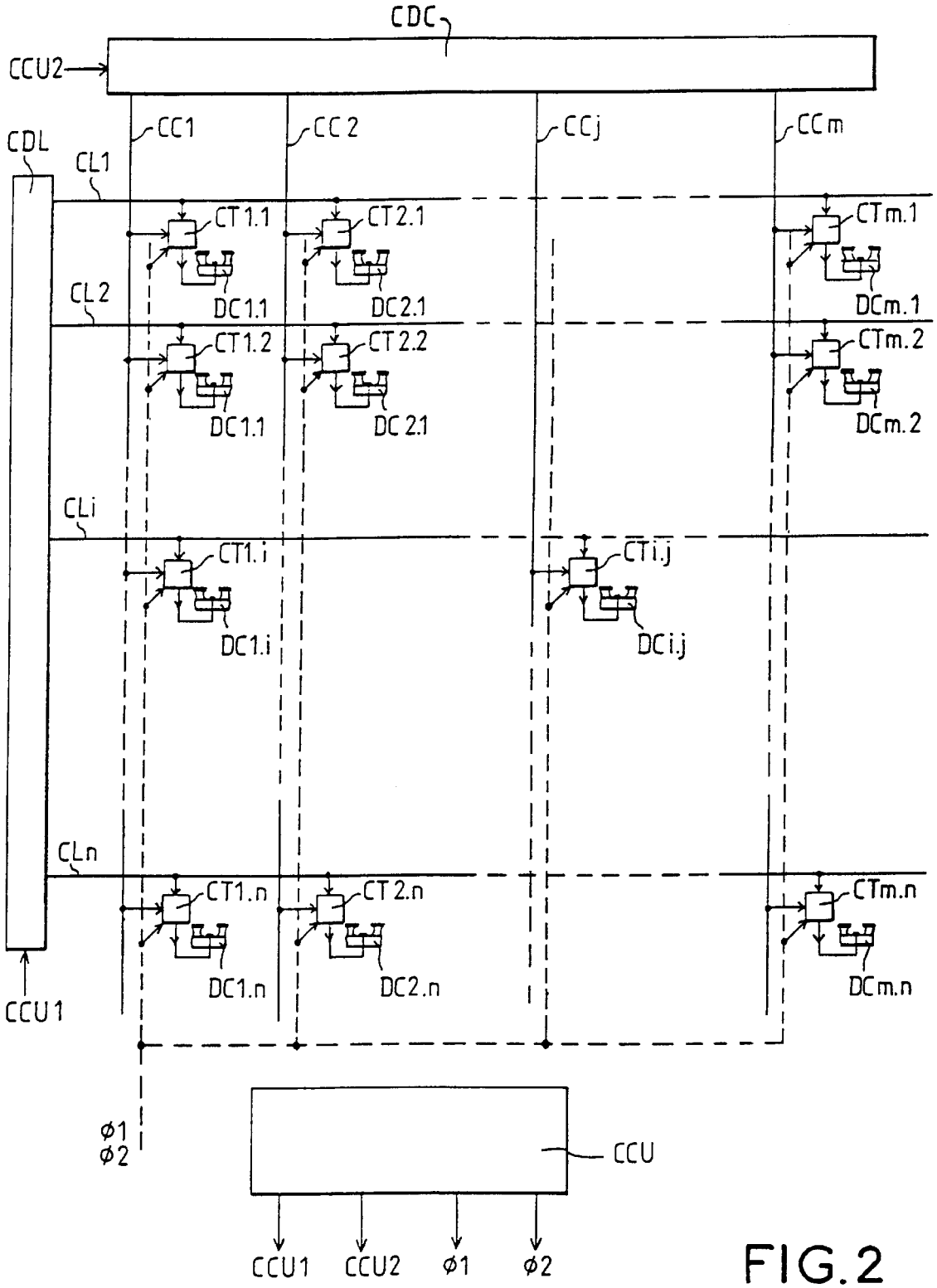
FIG. 2 represents a matrix of devices such as those in FIGS. 1*a* and 1*b;*

Such devices are arranged in rows and columns in order to permit matrix drive. FIG. 2 represents such an organization, comprising a matrix of cathodic emission devices DC1.1 to DCn.m which are connected to row wires CL1 to CLn and to column wires CC1 to CCm. Drive circuits CDL and CDC make it possible to apply drive potentials to the row wires and to the drive wires.

Figure 3:
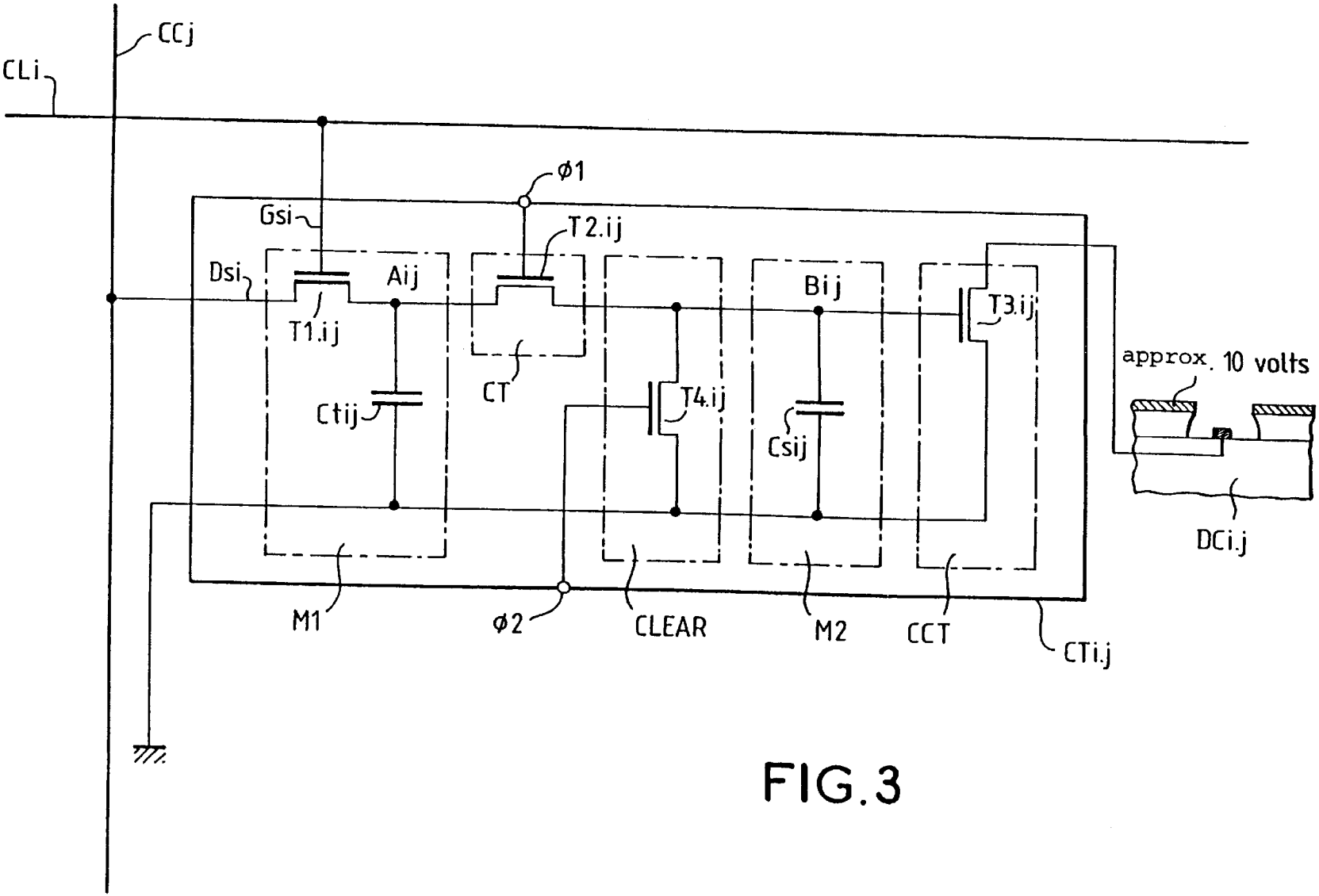
FIG. 3 represents a crossover-point drive circuit of a device of the matrix of FIG. 2.

Each cathodic emission device is connected to a row wire and to a column wire via a coincidence circuit or a crossover-point circuit DC1.1 to DCn.m. FIG. 3 represents, for example, the crossover-point circuit CTij connected to the row wire CLi (i=1 to n) and to the column wire CCj (j=1 to n).

Each crossover point of the matrix hence includes a circuit as represented in FIG. 3. The circuit includes a first transistor T1ij whose gate GSij is connected to a row wire CLi and whose source (or emitter) DSij is connected to a column wire CCj. A first capacitor Ctij is connected to the drain (or collector) of the transistor T1ij. A second transistor T2ij makes it possible to connect the capacitor Ctij, and more precisely the common point Aij of the capacitor Ctij and of the transistor T1ij, to a second capacitor Csij. The voltage level of this second capacitor Csij makes it possible to control the conduction of a third transistor T3ij which controls the current supply of the cathode of corresponding crossover point. More precisely, the second transistor T2ij makes it possible to connect the point Aij to the common point Bij of the capacitor and of the gate of the third transistor T3ij. Lastly, a fourth transistor T4ij makes it possible to short-circuit the second capacitor Csij in order to discharge it. The transistors T2ij and T4ij are driven by drive pulses applied to their gates at specific moments which are defined in the diagram of FIG. 4.

The mode of operation of the circuit of FIG. 3 will now be described with reference to FIG. 4.

The signals VGS1 to VGSn (represented by the lines VGS1=VGSn) correspond to the drive signals of the rows CL1 to CLn. It can hence is seen that, during a time T which corresponds to a frame time, all the rows have been driven one after the other. Attention will be paid, for example, to the drive signal VGSi of the row CLi. Its period is hence equal to T.

During each row-drive pulse such as VGSi, a column-drive pulse of a particular value (lying between 0 and 10 V) is applied to each column wire. From one row-drive pulse to the next, the values of the column pulses are changed according to the drive operation which it is desired to perform.

Figure 4:
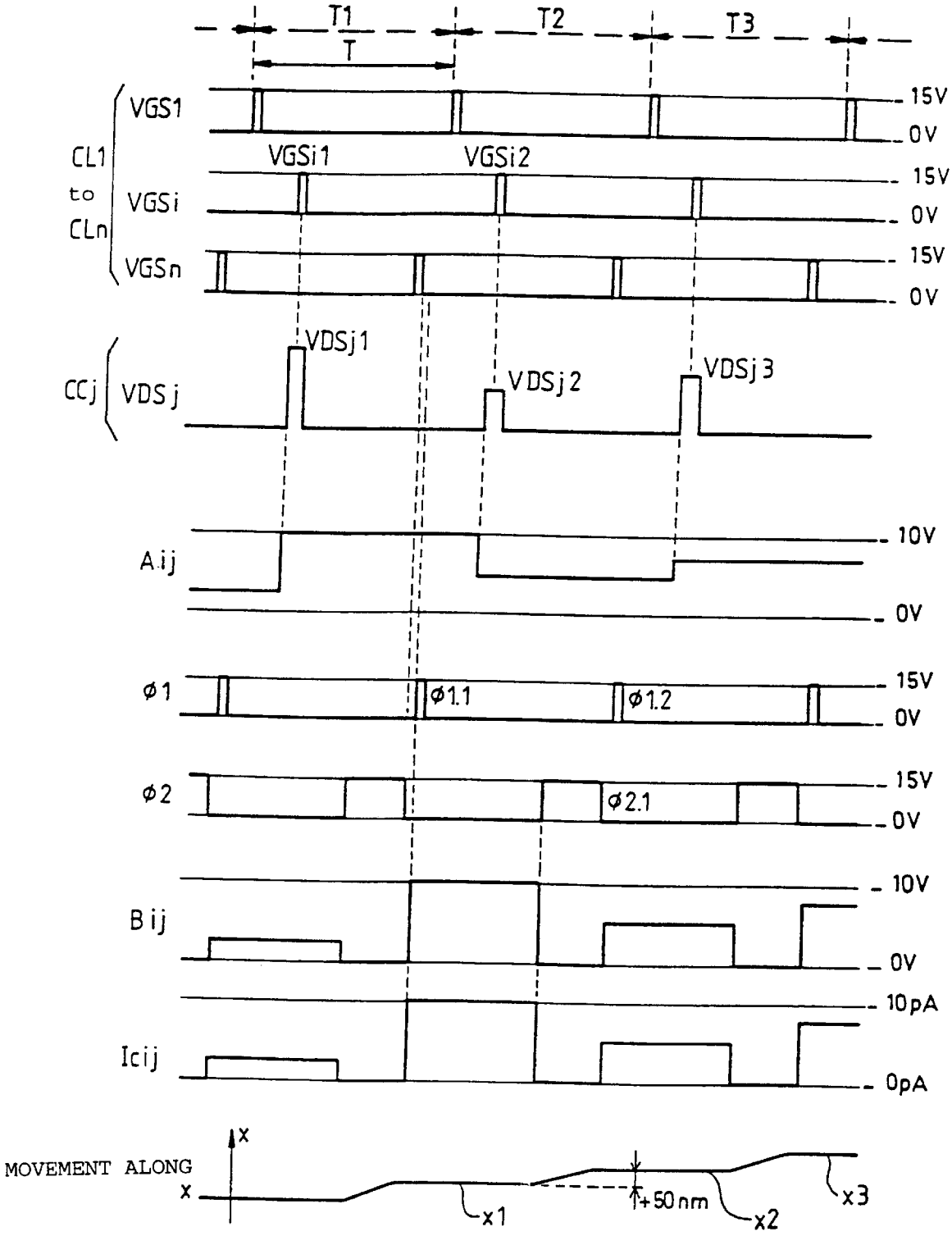
FIG. 4 represents a diagram of the operating times of the circuit of FIG. 3.

In FIG. 4, only the pulses VDSj sent on the column CCj and, in particular, to the crossover point of the row i and of the column j represented in FIG. 3, have been represented. During the frame time T1, the pulse VDSj1 has, for example, a value of 10 volts. During the frame time T2, the pulse VDSj2 has a value of 5 volts and, during the frame time T3, the pulse VDSj3 has a value of 7 volts.

The effect of the pulse VGSi1 is to turn on the transistor T1ij, which transmits the potential VDSj to the point Aij. The capacitor Ctij becomes charged between this potential and earth, that is to say to a potential of 10 volts in the case of the first pulse VDSj1.

At the end of period T1, a pulse $\phi$1.1 (row $\phi$1) which is produced after the last row-drive pulse VGSn of the frame T1, the transistor T2ij is turned on. It should be noted that this signal $\phi$1 is applied to all the transistors T2ij of the various crossover points of the matrix. In each crossover-point circuit, the point such as Aij is connected to the point Bij. The capacitor Csij is hence charged to the potential of Aij. The potential of the point Bij turns on the transistor T3ij, and the latter allows a current to flow to the device DCij and hence to the cathode of the crossover point to be driven. Following the pulse $\phi$1.1, the transistors such as T2ij disconnect the points Aij from the points Bij. The current supply of the device DCij is sustained by the transistor T3ij under the control of the capacitor Csij.

After the interruption of the pulse $\phi$1.1, the following frame time T2 begins. The column pulse VGSi2 causes the transistor T1ij to conduct. The potential VDSJ2 is transmitted to the point Aij and causes the capacitor Cti to charge.

Before the following pulse $\phi$1.2, a pulse $\phi$2.1 causes the transistors such as T4ij of the various crossover-point circuits to conduct. The role of these transistors is to earth the points Bij. All the capacitors such as Csij of the various crossover points are hence discharged. The transistors such as T3ij enter the off state and no longer conduct current to the devices such as DCij. Each pulse $\phi$2.1 lasts long enough to allow the capacitors Csij to discharge. When the pulses $\phi$2.1 cease, the system delivers the following pulse $\phi$1.2 for driving the transistors T2ij.

As was seen above, the capacitor Ctij of each crossover-point circuit has been charged under the control of the pulses VGSi2 and VDSj2. The conduction of the transistor T2ij causes the charge of the capacitor Ctij to be transferred to the capacitor Csij. The transistor T3ij is turned on again as a function of the voltage level of the capacitor Ctij. Operation then continues as has just been described.

It can hence be seen, as represented in FIG. 3, that a crossover-point circuit may be regarded as consisting:

- of a first memory circuit M1 connected to a row wire and to a column wire and comprising the transistor T1ij and the capacitor Ctij;
- of a second memory circuit M2 comprising the capacitor Csij;
- of a transfer circuit CT connecting the memory circuit M1 to the memory circuit M2 and comprising the transistor T2ij;
- of a current-control circuit CCT driven by the memory circuit M2 and comprising the transistor T3ij;
- of a circuit CLEAR for resetting the memory circuit M2 and comprising the consistent T4ij.

According to the mode of operation described above, the various rows are driven successively during a frame time.

Each time a row i is driven, the memories M1 of the row i are loaded with the data items of the columns. At the end of time of a frame, all the memories M1 of the matrix are loaded. The transfer circuit CT then brings about the transfer of the content of the memories M1 to the memories M2, then isolates the memories M2 from the memories M1. The memories M2 drive the current-control circuit CT while the data of the following frame time are being loaded into the memories M1. At the end of this following frame, the resetting circuit CLEAR erases the content of the memories M2, then the transfer circuit CT again brings about the transfer of the content of the memories M1 to the memories M2. Operation continues as described above.

It should be noted that the operation of the system is placed under the control of a central control circuit CCU. The latter drives the row-by-row scanning of the matrix and the sending, for each row-drive operation, of appropriate potentials on the column wires. The circuit CCU also delivers the signals $\phi$1 and $\phi$2 at the appropriate moments in conformity with the description above, for example according to the timing diagram of FIG. 4.

The last line of signals of FIG. 4 illustrates the application of the system to an electron gun. In such a type of application, the electron beam emitted by a cathode matrix is directed at a face of a (semiconductor) component to be processed. At a given moment it illuminates one component region, and at a subsequent moment the beam is moved on the surface of the component and illuminates a neighbouring region. The last line of FIG. 4 illustrates this movement. At a given moment, the beam illuminates a region x1. Next, the beam is moved (for example by 50 nm), the drive of the matrix is modified and the beam illuminates the region x2. Again, the beam is moved, the drive is modified, then the beam illuminates the region x3, etc.

What is claimed is:

1. A screen drive system comprising:

a matrix including rows and columns of cathodic emission devices that are driven one full row at a time; and a set of switching devices, each switching device configured to regulate current from a current source to a respective cathodic emission device throughout a time necessary to drive all rows of the matrix; wherein:

A) the coincidence circuit includes:

1) a first memory circuit connected to a row wire and to a column wire, and configured to store a data item transmitted on the column wire, 2) a transfer circuit configured to controllably transfer the data item stored in the first memory circuit to a second memory circuit, 3) the second memory circuit configured to store the data item transferred by the transfer circuit, and 4) a current-control circuit configured to control transmission of a defined current to the respective cathodic emission device as a function of the data item stored in the second memory circuit;

B) the system further comprises a central control circuit that is configured to sequentially control scanning of the rows of the matrix and send the data item on each column each time a row is driven so that the data item is then stored in the first memory circuit, and to control the transfer circuit of each coincidence circuit to transfer the data item from the first memory circuit to the second memory circuit at an end of a frame scan of the matrix.

2. The system of claim 1, wherein each coincidence circuit further includes:

a resetting circuit configured to erase the content of the second memory at the end of a frame and before the transfer circuit transfers the data item from the first memory circuit to the second memory circuit.

3. The system of claim 1, wherein each of the first and second memory circuits includes:

a capacitor capable of being charged to potential levels corresponding to the data item received on the column wire.

4. The system of claim 1, wherein:

each cathodic emission device includes a cathode that is made of a conductive material with low electron affinity and of amorphous structure, whereby a current required from the current source is reduced by a factor of about the number of rows in the matrix as compared to matrices including cathodic emission devices not using said conductive material with low electron affinity.

5. The system of claim 1, wherein each switching device further includes:

a coincidence circuit, connected to a row wire to receive a row wire potential, and connected to a column wire to receive a column wire potential; and a connection circuit included in the current-control circuit, and configured to connect the cathodic emission device to the current source in response to the coincidence circuit, and to conduct current of a magnitude corresponding to the column wire potential.

6. the system of claim 5, wherein each first memory circuit includes:

a first capacitor connected to a first point that is between the coincidence circuit and the connection circuit.

7. The system of claim 6, wherein:

each second memory circuit includes a second capacitor connected to a second point that is between the first point and the connection circuit; and the transfer circuit is configured to controllably connect the first capacitor at the first point to the second capacitor at the second point.

8. The system of claim 1, further comprising:

at least one anode facing the matrix of cathodic emission devices.

9. The system of claim 1, wherein:

each cathodic emission device includes a cathode that is made of a material with low electron affinity, whereby a current required from the current source is reduced by a factor of about the number of rows in the matrix as compared to matrices including cathodic emission devices not using said conductive material with low electron affinity.

10. A screen drive system comprising:

a) a matrix including rows and columns of cathodic emission devices that are driven one full row at a time; and b) a set of switching devices, each switching device configured to regulate current from a current source to a respective cathodic emission device throughout a time necessary to drive all rows of the matrix, wherein each switching device includes:

1) a coincidence circuit;

2) a connection circuit;

3) a first capacitor connected to a first point that is between the coincidence circuit and the connection circuit;

4) a second capacitor connected to a second point that is between the first point and the connection circuit; and 5) a transfer circuit configured to controllably connect the first capacitor at the first point to the second capacitor at the second point.

11. The system of claim 10, wherein:

A) each switching device includes:

1) a first memory circuit that includes the first capacitor, and that is connected to a row wire and to a column wire, and configured to store a data item transmitted on the column wire, 2) a second memory circuit that includes the second capacitor, and that is configured to store the data item transferred by the transfer circuit, and 3) a current-control circuit that includes the connection circuit, and that is configured to control transmission of a defined current to the respective cathodic emission device as a function of the data item stored in the second memory circuit; and B) the system further comprises a central control circuit that is configured to sequentially control scanning of the rows of the matrix and send the data item on each column each time a row is driven so that the data item is then stored in the first memory circuit, and to control the transfer circuit of each switching device to transfer the data item from the first memory circuit to the second memory circuit at an end of a frame scan of the matrix.

12. The system of claim 11 wherein each switching device further includes:

a resetting circuit configured to erase the content of the second memory at the end of a frame and before the transfer circuit transfers the data item from the first memory circuit to the second memory circuit.

13. The system of claim 11, wherein:

the first and second capacitors are configured to be charged to potential levels corresponding to the data item received on the column wire.

14. The system of claim 10, wherein:

each cathodic emission device includes a cathode that is made of a conductive material with low electron affinity and of amorphous structure, whereby a current required from the current source is reduced by a factor of about the number of rows in the matrix as compared to matrices including cathodic emission devices not using said conductive material with low electron affinity.

15. The system of claim 10, wherein:

the coincidence circuit is connected to a row wire to receive a row wire potential, and to a column wire to receive a column wire potential; and the connection circuit is configured to connect the cathodic emission device to the current source in response to the coincidence circuit, and to conduct current of a magnitude corresponding to the column wire potential.

16. The system of claim 10, further comprising:

at least one anode facing the matrix of cathodic emission devices.

17. The system of claim 10, wherein:

each cathodic emission device includes a cathode that is made of a material with low electron affinity, whereby a current required from the current source is reduced by a factor of about the number of rows in the matrix as compared to matrices including cathodic emission devices not using said conductive material with low electron affinity.

* * * * *